US007043782B2

(12) United States Patent
Batchler

(10) Patent No.: US 7,043,782 B2
(45) Date of Patent: May 16, 2006

(54) FEET AND LEGS WARMER

(76) Inventor: Sharon Louise Batchler, 22637 Byron St., Hayward, CA (US) 94541

( * ) Notice: Subject to any disclaimer, the term of this patent is extended or adjusted under 35 U.S.C. 154(b) by 197 days.

(21) Appl. No.: 10/893,622

(22) Filed: Jul. 16, 2004

(65) Prior Publication Data

US 2006/0010599 A1 Jan. 19, 2006

(51) Int. Cl.
*A47G 9/02* (2006.01)
*A47G 9/00* (2006.01)

(52) U.S. Cl. ..... 5/485; 5/482; 2/69.5

(58) Field of Classification Search ..... 5/482, 5/494, 485; 2/69, 69.5, 247, 253
See application file for complete search history.

(56) References Cited

U.S. PATENT DOCUMENTS 174,920 A * 3/1876 Milwain ..... 2/69
2,530,606 A * 11/1950 Farrington ..... 2/69.5
2,705,325 A * 4/1955 Bogenberger ..... 2/69
4,880,415 A 11/1989 Urakami
5,007,125 A 4/1991 Owenby
5,497,521 A * 3/1996 Waits et al. ..... 5/658
5,509,156 A * 4/1996 Smith ..... 5/482
5,604,932 A * 2/1997 Lawicki ..... 2/69.5
5,611,095 A * 3/1997 Schneider ..... 5/482
5,956,768 A * 9/1999 Pearson ..... 2/69.5
5,970,542 A * 10/1999 Mays ..... 5/485
6,124,578 A 9/2000 Elliott

* cited by examiner

*Primary Examiner*—Alexander Grosz

(57) ABSTRACT

This invention pertains to an article designed to warm and comfort the feet. It comprises of fabric material designed and sewn in such a way wherein both feet and legs are inserted and totally enclosed for a snug fit. It also comprises of a snap at the top center edge, and elastic on portions of the top edge.

3 Claims, 2 Drawing Sheets

FEET AND LEGS WARMER

BACKGROUND OF THE INVENTION

This invention pertains to the field and technology of warming the feet. In addition to warming the feet, it provides comfort and relaxation.

Blankets have been commonly utilized for the purpose of warming the feet. This is probably one of the more frequently used methods than others. However, there is a shortcoming to the use of the blanket as cited in U.S. Pat. No. 5,007,125. While being used, it can be moved out of place in such a way that the feet become uncovered and exposed; therefore defeating the purpose of warming the feet.

Other types of methods to warm the feet include the common hot water bottle or similar devices that are filled with water and placed on the feet as in U.S. Pat. No. 6,124,578. Another example is U.S. Pat. No. 4,880,415 where the feet are soaked and warmed in a bathing agent.

There appears to be a need for an improved and more convenient method of warming and comforting the feet. In particular, one that does not have the potential of leaving the feet uncovered and exposed. The new and interesting invention addresses these needs. It is utilized with ease and simplicity. No water is needed whatsoever.

BRIEF SUMMARY OF THE INVENTION

A resolution to the problems of previous feet warming devices has now been found in the new and convenient invention. There is no known precedence of its kind. The main objective of the invention is to warm and comfort the feet. The advantage is that the feet are warmed without becoming uncovered and exposed. In addition, the convenience of use is a great asset.

DETAILED DESCRIPTION OF THE INVENTION

Figure 1:
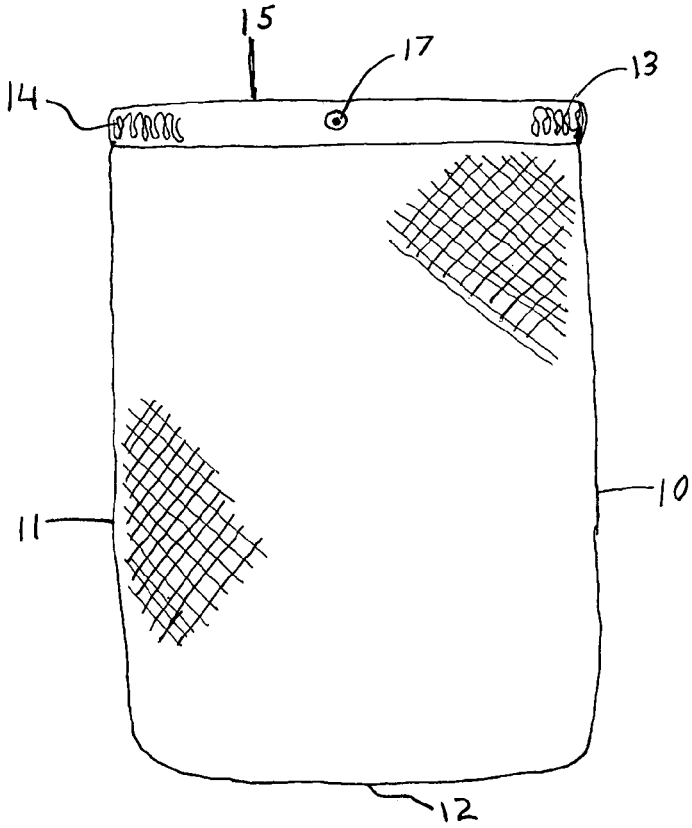
FIG. 1 depicts a front and rear view of the new invention, showing the innovative design

Now referring specifically to FIG. 1, you will find depicted a front and rear view of the invention entitled feet and legs warmer. Due to the fact that the front and rear views are exactly the same, only a single view is necessary. Viewing FIG. 1 in its entirety, the configuration resembles that of a rectangle. The left seam 11, and right seam 10, enables the Warm Feet invention to be enclosed. A bottom fold 12 of the fabric material, instead of a seam, enhances comfort of the feet. A strip of elastic 13 and 14 is used to provide a secure and snug fit. The top edge depicted in 15 has no seam that binds the edge closed, but instead is left open. This allows both feet and legs of the user to be inserted. 17 clearly show a front snap. With feet totally covered and enclosed, perfect conditions are created that produce warmth and comfort.

Figure 2:
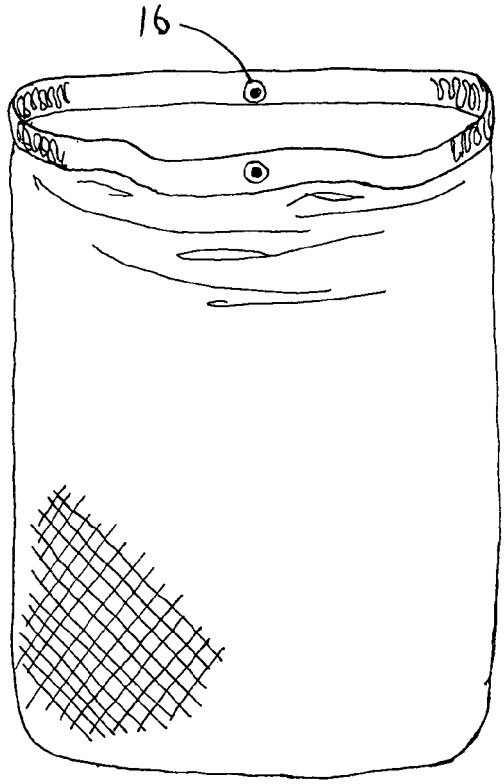
FIG. 2 is a front view showing a rear snap

Turning to FIG. 2, the illustration shows a slightly different position than FIG. 1. The front top edge is shown pulled down just a bit to reveal a rear snap 16.

Figure 3:
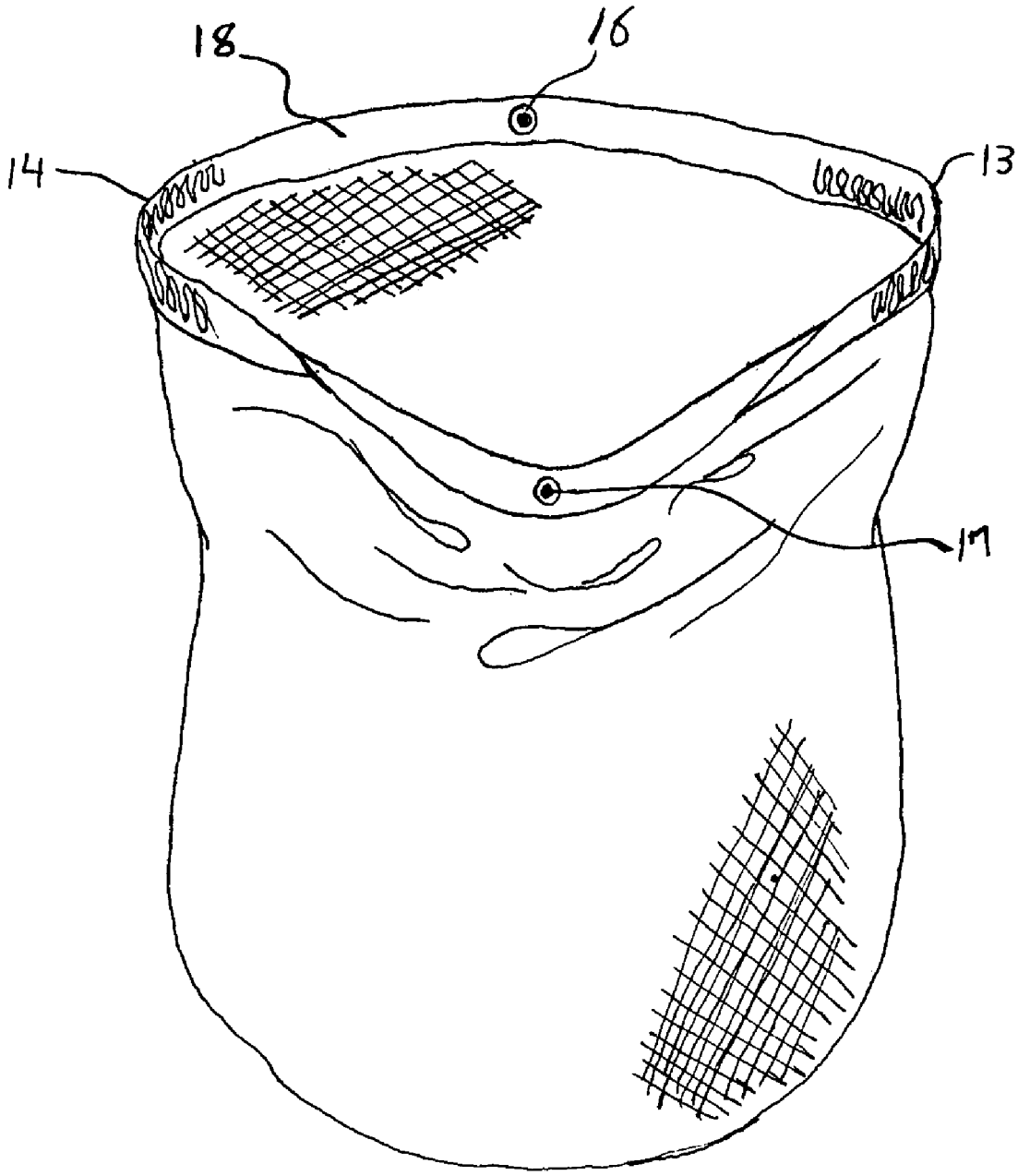
FIG. 3 shows the invention, looking from the top and reveals rear and front snaps. Also shows the border

Now describing FIG. 3 in its entirety, the drawing is viewed looking from the top. The invention is shown in the open position making it easily seen where the feet and legs are inserted. You will notice 16 rear snap, and 17 front snap. These snap together therefore bringing the front and rear portions of the invention together (between the legs). This snapping together as well as the elastic previously mentioned ensure a snug fit and therefore provide the desired warmth and comfort.

Referring again to 13 and 14 of FIG. 3, an elastic strip is sewn within the border 18. The border is formed by folding down a small portion of fabric of the top edge 15 of FIG. 1. This folded down portion of fabric includes the entire top edge that surrounds the invention. A seam is made on the entire folded down portion of fabric and keeps the border in place, giving the invention a neat finish.

The invention is intended to be used while sitting and having bare feet. The preferred fabric is inherently insulating fleece or any fabric that blankets are made of, thus satisfying the desire for warm and comfortable feet. The size of the designed article is 20 inches in width and 25 inches in length. As mentioned previously, the Warm Feet invention provides a snug fit wherein the user's feet and legs are inserted. The feet are totally covered and enclosed allowing for little or no opportunity of exposure. The ease of use is an additional benefit.

The foregoing description has shown clearly the purpose, necessity, advantage, and ease of use of the invention. Any variation thereof regarding size, type of fabric, color etc. is understood to be within the scope of the invention.

What is claimed is:

1. A foot warmer adapted to accommodate both feet and legs of a user, comprising a generally rectangular insulating fabric bag, including front and rear panels, the bag having three closed sides and an open top that has an elastic strip therein, the top portions of the front and rear panels including snap fastener means, located only at central areas thereof, adapted to be releasably secured to each other between the legs of a user.

2. The foot warmer of claim 1, having a width of 20 inches, and a length of 25 inches.

3. The foot warmer of claim 1, wherein the insulating fabric is a fleece material.

* * * * *